US012649548B2

(12) United States Patent
Parten

(10) Patent No.: US 12,649,548 B2
(45) Date of Patent: Jun. 9, 2026

(54) TACKING RUDDER FOR PERSONAL FLOTATION DEVICE, AND METHOD OF USE

(71) Applicant: Randall L. Parten, Blaine, WA (US)

(72) Inventor: Randall L. Parten, Blaine, WA (US)

( * ) Notice: Subject to any disclaimer, the term of this patent is extended or adjusted under 35 U.S.C. 154(b) by 83 days.

(21) Appl. No.: 16/695,014

(22) Filed: Nov. 25, 2019

(65) Prior Publication Data

US 2020/0164951 A1 May 28, 2020

Related U.S. Application Data

(60) Provisional application No. 62/771,016, filed on Nov. 23, 2018.

(51) Int. Cl.
*B63B 34/45* (2020.01)
*B63B 34/54* (2020.01)
*B63B 34/67* (2020.01)

(52) U.S. Cl.
CPC ..... *B63B 34/45* (2020.02); *B63B 34/54* (2020.02); *B63B 34/67* (2020.02)

(58) Field of Classification Search
CPC ..... B63B 34/35; B63B 34/54; B63B 34/67; B63C 9/26; B63C 9/082
USPC ..... 441/80, 84, 81, 88, 129, 130, 133
See application file for complete search history.

(56) References Cited

U.S. PATENT DOCUMENTS 388,384 A * 8/1888 Woodworth ..... B63B 22/163 441/12
4,461,115 A * 7/1984 Carrillo ..... A01K 93/00 43/43.13
4,976,642 A * 12/1990 Wilkie ..... B63C 9/082 441/131
5,826,765 A * 10/1998 Rak ..... B60R 9/045 224/326
6,615,762 B1 * 9/2003 Scott ..... B63B 7/06 114/353
7,367,153 B1 * 5/2008 Koch, III ..... A01K 73/045 43/43.13
8,496,507 B2 * 7/2013 Poston ..... B63H 19/04 441/80

FOREIGN PATENT DOCUMENTS

CN 105431348 B * 11/2017 ..... B63B 1/40

* cited by examiner

*Primary Examiner* — Daniel V Venne
(74) *Attorney, Agent, or Firm* — Bryan E. Repetto; Repetto Law, P.C.

(57) ABSTRACT

A towable personal flotation device (PFD) is provided that includes a rudder attached to the device so as to extend into the water when the PFD is towed through water. The rudder is positioned, relative to the direction of travel, such that water flowing across the rudder imparts a lateral force to the rudder, causing the PFD to follow a parallel course. Methods are also provided, for delivering the personal flotation device to a person in or across the water.

1 Claim, 11 Drawing Sheets

TACKING RUDDER FOR PERSONAL FLOTATION DEVICE, AND METHOD OF USE

BACKGROUND

Field of the Invention

The present invention relates generally to personal flotation devices, and, more particularly, to flotation devices configured to be towed by a boat so as to be delivered to a person in the water.

Related Art

Watercraft above a particular limit in size are typically required to carry one or more personal flotation devices (PFD), with lines attached, in locations where they are easily accessible to be thrown to a "man overboard" (MOB). a common scenario is for a passenger or crew member to fall overboard while a vessel is underway, whereupon a PFD is tossed into the water, to be towed behind the vessel. The helmsman steers the vessel back toward the MOB and loops around the MOB so as to bring the PFD or the towline into reach of the MOB. The MOB is then pulled to the vessel via the towline and brought back aboard.

FIG. 1 is a diagram illustrating a procedure for bringing a PFD 50, towed behind a sailboat 52, into the reach of a "man overboard" 54 (MOB), A similar diagram can be obtained from http://www.h260.com/safety/safetyl.html. Briefly, the MOB 54 enters the water at a, the sailboat 52 begins to turn at b, and at c deploys the PFD 50. At e and f the sailboat 52 turns through the wind—the wind direction is indicated at $W_1$. At g the sailboat backs the headsail, continues turning at h, and jibes at j. The sailboat reaches at k, approaches at l and comes directly into the wind at m, where it heaves to and the MOB is recovered. If performed properly, the towed PFD 52 follows a spiral course, as shown, to a point within the reach of the MOB. Of course, the diagram of FIG. 1 is not to scale, and the recovery drill can occupy a large area, depending upon the wind, waves, and skill of the boat crew. However, it is important that the steps from about g-m are performed as close to the MOB 54 as possible, in order to bring the PFD 52 into reach of the MOB 54.

There are similar procedures that are commonly taught for use by operators of motorboats.

SUMMARY OF THE INVENTION

According to an embodiment, a towable personal flotation device (PFD) is provided that includes a rudder attached to the device so as to extend into the water when the PFD is towed through water. The rudder is positioned, relative to the direction of travel, such that water flowing across the rudder imparts a lateral force to the rudder, causing the PFD to follow a parallel course. Methods are also provided, for delivering the personal flotation device to a person in or across the water.

According to an embodiment, the personal flotation device is in the form of a life ring.

According to an embodiment, the tacking rudder is one of a plurality of tacking rudders extending from a same side of the personal flotation device.

According to an embodiment, the personal flotation device is in the form of a buoyant seat cushion, and the tacking rudder is in the form of a seat back attached to the cushion and extending therefrom.

According to an embodiment, personal flotation device comprises a deflection face configured to apply a downward force when the personal flotation device is towed through the water.

According to an embodiment, the personal flotation device is in the form of a water ski tow rope handle, and includes a cross bar coupled to a tow rope via a yoke, and the tacking rudder is one of two tacking rudders, a first coupled to one side of the yoke and extending in a first direction, the other of the two tacking rudders coupled to the other side of the yoke and extending in a second direction, opposite the first direction.

According to an embodiment, a method is provided, for delivering a personal flotation device, and includes attaching the personal flotation device to a first end of a towline, and placing the personal flotation device in water, with a tacking rudder extending downward into the water from the personal flotation device such that, as water flows across the tacking rudder and imparts a force to the device parallel to an axis lying lateral to a direction of water flow relative to the personal flotation device.

BRIEF DESCRIPTION OF THE DRAWINGS

FIGS. 8-11 are views of a PFD tacking device of FIGS. 2-5 in various configurations, according to an embodiment, in which FIG. 8 is a bottom plan view, FIG. 9 is a side elevation view along an axis defined by a hinge, FIG. 10 is a side elevation view of the device in a deployed configuration, and FIG. 11 is a side elevation view of the device in a stowed configuration.

DETAILED DESCRIPTION

In some of the drawings, elements are designated with a reference number followed by a letter, e.g., "218*a*, 218*b*." In such cases, the letter designation is used where it may be useful in the corresponding description to refer to or differentiate between specific ones of a number of otherwise similar or identical elements, or between versions of a same element, separated by time or position. Where the description omits the letter from a reference, and refers to such elements by number only, this can be understood as a general reference to the elements identified by that reference number, unless other distinguishing language is used.

The challenge of bringing a PFD (personal flotation device) towed behind a water vessel into the reach of a MOB (man-overboard) can be very difficult. In calm conditions, with an expert helmsman, aboard a motorboat, it can take several passes to bring the PFD within reach, and each pass can require ninety second or more, in addition to the time it takes the boat to return to the MOB. Thus, under ideal conditions, it is often five or more minutes from the time a person falls into the water until a PFD is brought into reach. The time necessary to reach the MOB with a PFD can be much longer than this if any complicating factors are present. Complicating factors can include, for example, weather and water conditions, operating under sail (rather than under motor power), boat size (larger boats have greater turning radii and less visibility for the helmsman), inexpert helmsman (in about half of all MOB cases, the person who falls overboard is the individual who is piloting the boat, and who is often the only skilled operator on board), poor visibility due to darkness or fog, etc.

Extended time in the water can significantly reduce the likelihood of survival for a MOB. In most seas, a person who falls in the water loses the ability to grasp an object within one or two minutes, and becomes progressively weaker, less coordinated, and less able to assist in his own rescue. It is not uncommon for a MOB to be brought back to the side of a boat, but to be too incapacitated by the cold to pull himself back aboard, with no one else able to bring him aboard as dead weight. For all the reasons outlined above, a large percentage of reported MOB cases in which the MOB is reached without a search, and brought back to the boat, result in the death of the MOB.

Figure 1:
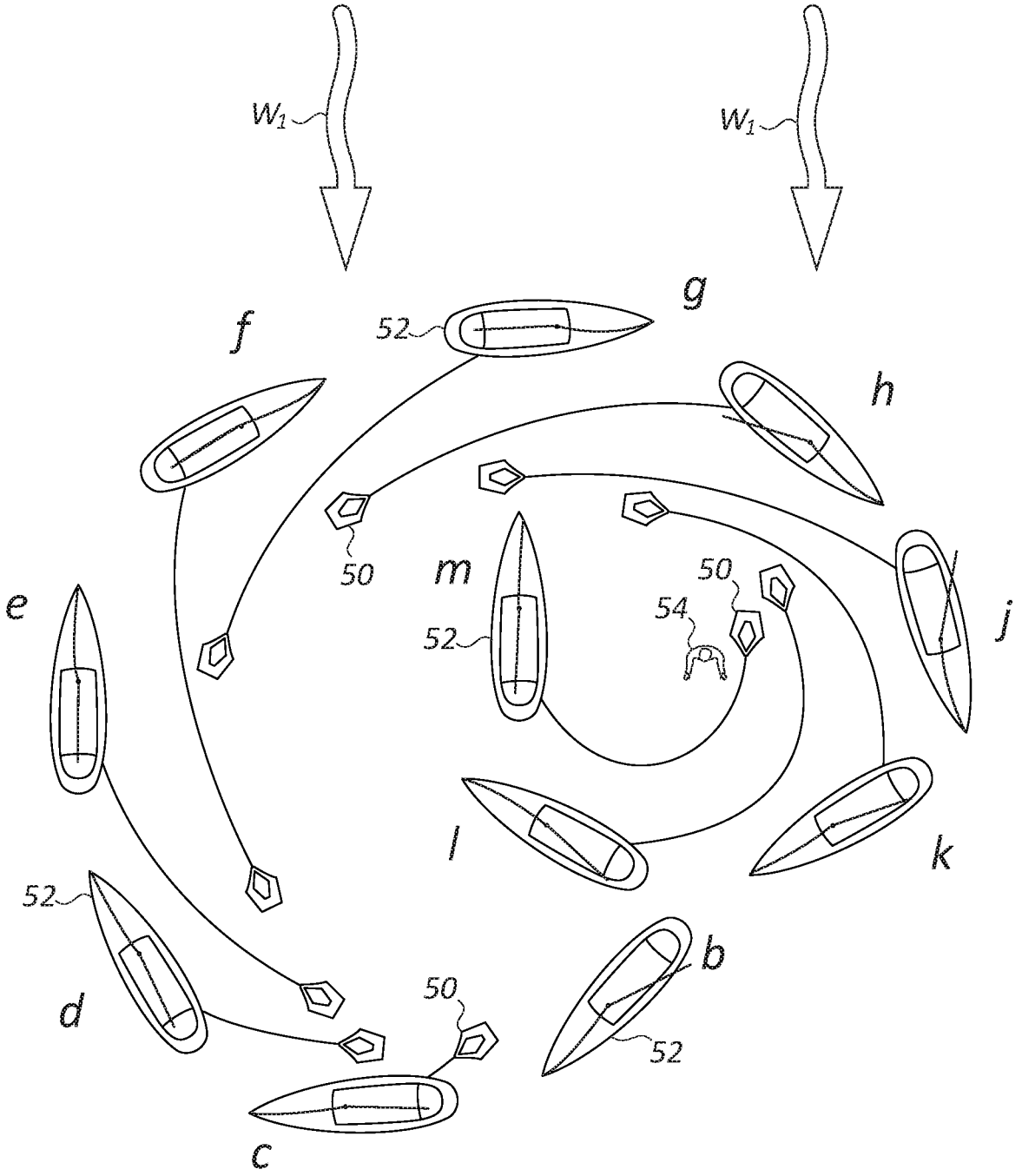
FIG. 1 is a diagram illustrating a procedure for bringing a PFD, towed behind a sailboat, into the reach of a "man overboard."
Figure 2:
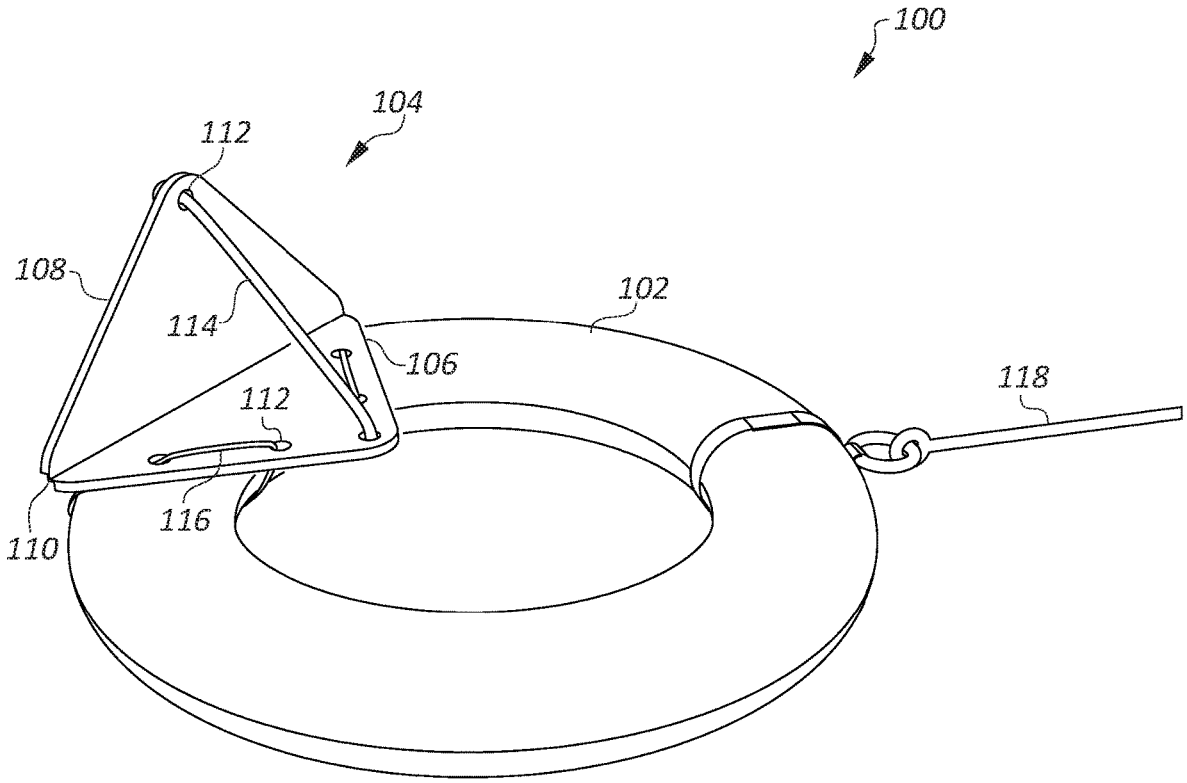
FIG. 2 is a perspective view of a tacking PFD, according to an embodiment.

FIG. 2 is a lower perspective view of a tacking PFD 100, which includes a PFD 102—in this case, a life ring—and a PFD tacking device 104, according to an embodiment. The PFD tacking device 104 includes a base plate 106 and a tacking rudder 108 coupled to the base plate by a hinge 110. The base plate 106 and tacking rudder 108 include a plurality of apertures 112 in selected locations. The angle of the tacking rudder 108 relative to the base plate 106 is limited to a selected maximum angle by a limiting strap 114 extending between two of the plurality of apertures 112, one each in the base plate and the tacking rudder. The PFD tacking device 104 is coupled to the PFD 102 by a pair of straps 116 extending through respective pairs of the plurality of apertures 112 and around a portion of the PFD. A towline 118 is coupled at one end to the PFD 102, and has a length appropriate to be towed behind a boat in a MOB recovery maneuver.

The term tacking is used herein to refer an action in which a force is applied to a floating object in a direction that is lateral, with respect to a direction of a current flowing past the floating object.

While the PFD 102 is shown in FIG. 2 as a life ring, this is merely by way of example. According to various embodiments, PFD tacking devices are provided for use with many different types of PFDs, including flotation cushions, Lifesling®, inflatable PFDs, torpedo PFDs, etc.

When the tacking PFD is not in use, the hinge 110 permits the tacking rudder 104 to fold down toward the baseplate 106, for compact stowage. According to an embodiment, the hinge 110 has a spring tension that biases the tacking rudder 108 toward an open position. When deployed, the spring bias assists in moving the tacking rudder 108 to the position shown in FIG. 2, to the extent permitted by the limiting strap 114. When deployed, a user positions the tacking PFD 100 in the water with the tacking rudder 108 extending downward from the baseplate 108, i.e., with the upper side of the device, as viewed in FIG. 2, facing downward in the water.

Figure 3:
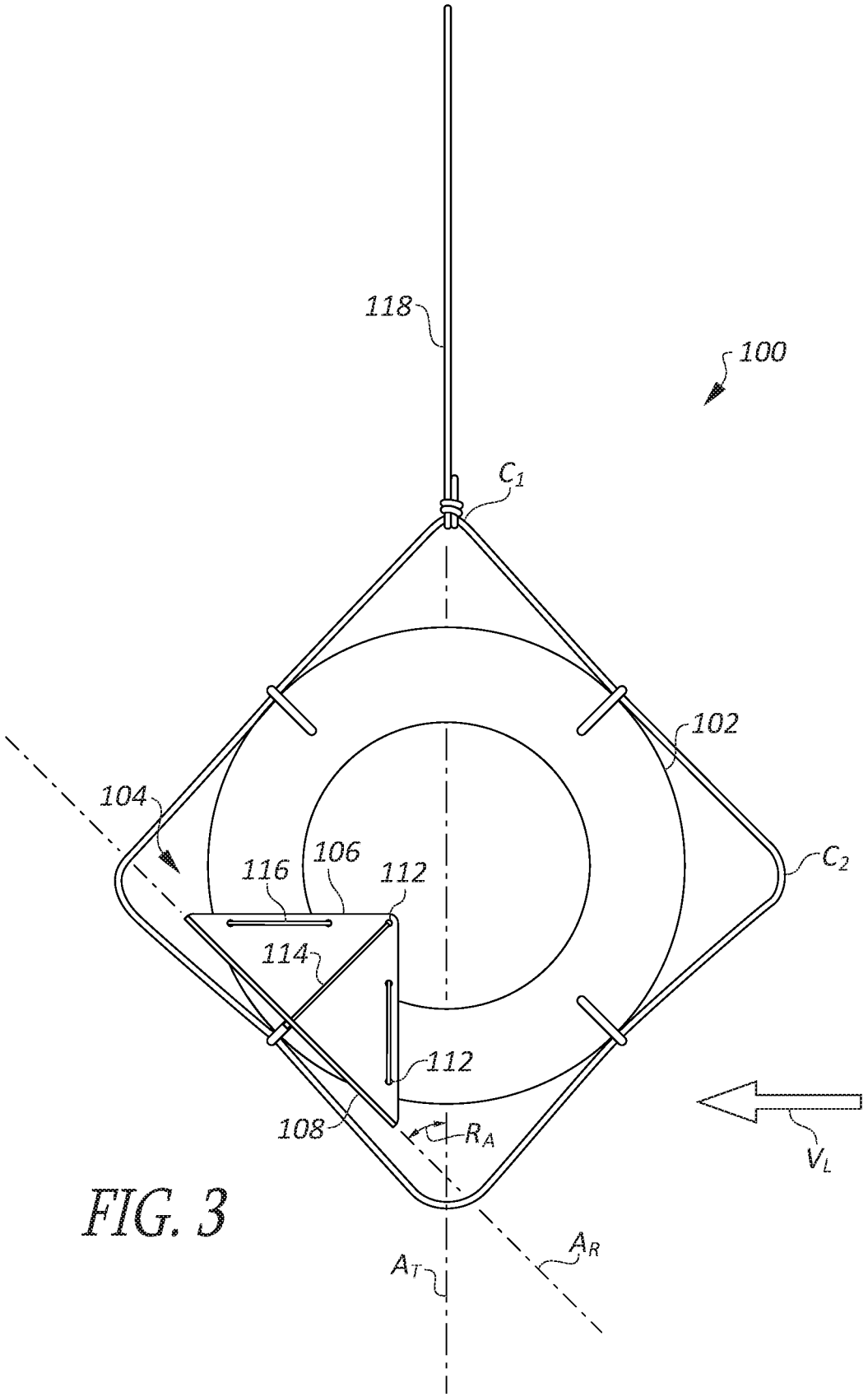
FIG. 3 is a bottom plan view of the tacking PFD of FIG. 2, according to an embodiment.

FIG. 3 is a bottom plan view of the tacking PFD 100 of FIG. 2, according to an embodiment, showing the position of the PFD tacking device 104 on the PFD 102. The towline 118 defines a tow axis $A_T$ extending through the PFD 102 from the point at which the towline is coupled, at $C_1$, and in substantial alignment with the towline. With the PFD tacking device 104 attached to the PFD 102, the hinge 110 and tacking rudder 108 define a rudder axis $A_R$ that lies at a rudder angle $R_A$ relative to the tow axis $A_T$. According to an embodiment, the PFD tacking device 104 is positioned so as to place the rudder axis $A_R$ at an acute rudder angle. In the embodiment shown, the rudder axis $A_R$ is at a rudder angle $R_A$ of about 45°.

The rudder angle $R_A$ is a fixed value, established by the position of the PFD tacking device 104 on the PFD 102, relative to a nominal tow axis $A_T$. According to an embodiment, the rudder axis $A_R$ is at a rudder angle $R_A$ of between 15° and 85°. According to another embodiment, the rudder axis $A_R$ is at a rudder angle $R_A$ of between 30° and 60°. According to a further embodiment, the rudder axis $A_R$ is at an angle $R_A$ of between 40° and 50°.

When the tacking PFD 100 is towed by the towline 118 in the water, water flowing past the PFD tacking device 104 applies an asymmetrical force on the device, because of the angled face of the tacking rudder 108. This, in turn, applies a lateral force along a vector $V_L$ to the tacking PFD 100. As a consequence, the tacking PFD 100 tends to move laterally, relative to the direction of travel, until an equilibrium is reached between a longitudinal force applied by the flow of water past the device, and the lateral force, so that the PFD 100 tends to travels along a line parallel to, but not directly behind the boat.

The direction of the lateral force—i.e., to the left or the right—can be selected by selection of the coupling point of the towline 118. With the towline 118 coupled at $C_1$, the lateral force along vector $V_L$ is applied, which pushes the tacking PFD 100 in that same direction. However, if the towline is coupled a $C_2$, the PFD tacking device 104 is moved to the opposite side of the tow axis $A_T$, which results in a lateral force along an opposite vector being applied, resulting in movement in the opposite direction.

Figure 4:
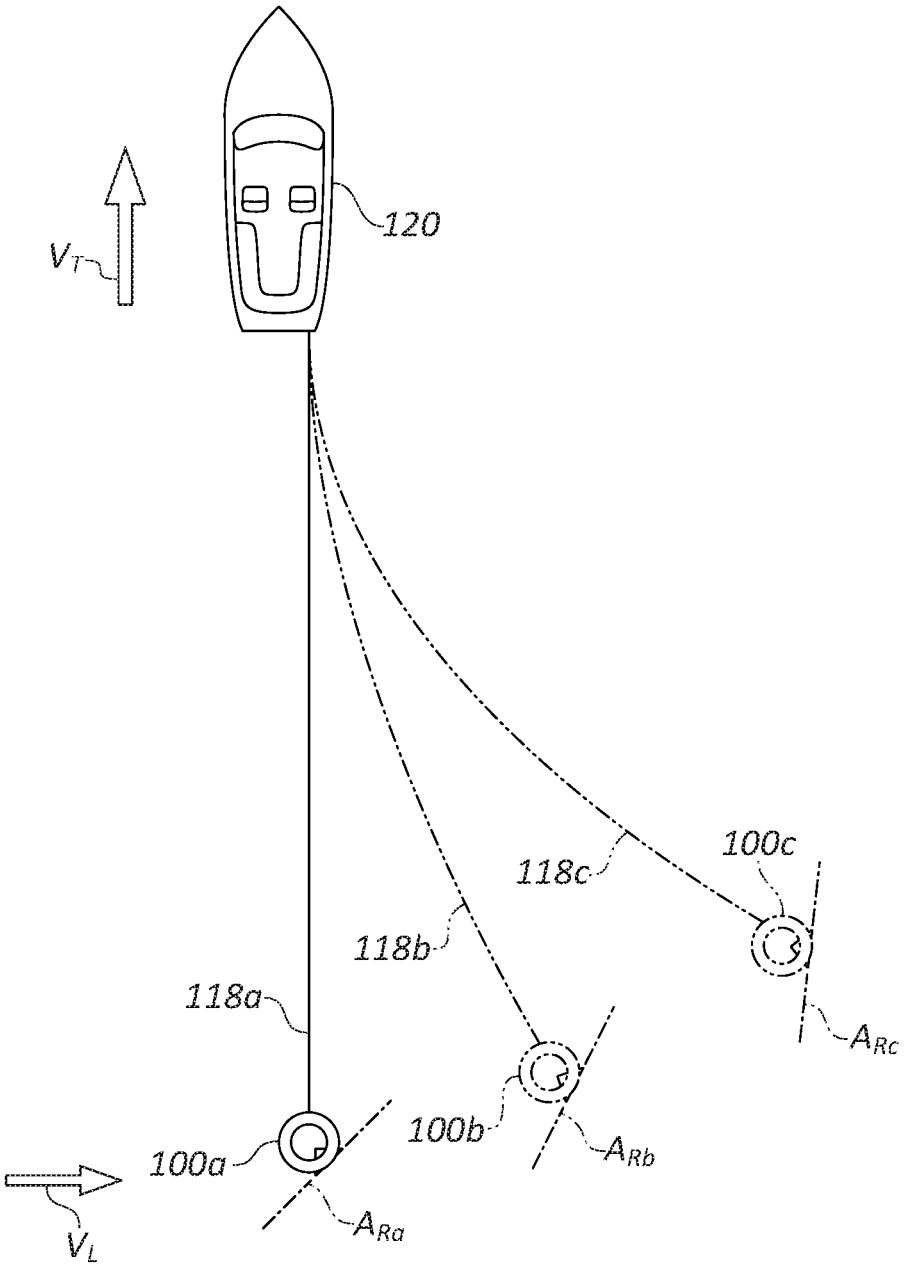
FIG. 4 is a diagrammatic top plan view, according to an embodiment, of a boat with a towline attached to the transom and a tacking PFD coupled to the other end of the towline.

This behavior is illustrated in FIG. 4, which is a diagrammatic top plan view, according to an embodiment, of a boat 120 with a towline 118 attached to the transom on one side, and a tacking PFD 100 coupled to the other end of the towline. The boat 120 travels in a straight line along a vector of travel $V_T$. As the boat begins to tow the tacking PFD 100, the towline 118*a* and tacking PFD 100*a* are aligned parallel with the vector $V_T$, and the rudder axis $A_{Ra}$ of the tacking device 104 is lying at about 45° relative to the vector of travel $V_T$. Movement of the tacking PFD 100 at the end of the towline 118 is shown in phantom lines, with the positions of the towline at 118*b* and the tacking PFD at 100*b* representing an intermediate position, and the positions of the towline at 118*c* and the tacking PFD at 100*c* representing a position of equilibrium, at which the force of the water current prevents further lateral movement of the PFD at 100. The corresponding orientation of the rudder axis $A_{Ra}$, $A_{Rb}$, and $A_{Rc}$ is also shown at its respective positions.

It should be noted that the lateral force along the vector $V_L$ is greatest when the rudder axis $A_R$ is at 45° relative to the vector of travel $V_T$, and diminishes as the angle moves above or below that value. Referring again to FIG. 4, as the tacking PFD moves laterally, the tow axis, which is at least nominally defined by the position and angle of the towline 118 where it is coupled to the PFD (see FIG. 3), does not remain aligned with the vector of travel $V_T$, and as the tacking PFD 100 moves further, laterally, the rudder axis $A_{Rb}$, $A_{Rc}$ becomes progressively smaller, relative to the vector of travel $V_T$, with a corresponding reduction in the strength of the lateral force along the vector $V_L$.

If the rudder angle $R_A$ is established at a value that is greater than 45°, the angle of the rudder axis $A_R$, relative to the vector of travel $V_T$, is initially also greater than 45°, so the initial lateral force is reduced. However, with a greater rudder angle $R_A$, the angle of the rudder axis $A_R$, relative to the vector of travel $V_T$, remains relatively higher as the tacking PFD 100 moves laterally, with a corresponding relative improvement in the lateral force as the PFD 100 moves outward. Thus, with a higher rudder angle $R_A$, the PFD 100 will initially move laterally more slowly than with a rudder angle $R_A$ of 45° but will move further out. Furthermore, the speed of movement, laterally, will be directly related to the speed of the boat towing the device. On the other hand, because the opposing force of the water current is a primary limiting factor to the lateral movement of the tacking PFD 100, the lateral position of the tacking PFD, relative to the boat 120, is inversely related to the speed of the boat. In other words, at higher speeds, the lateral movement will be less than at lower speeds. Therefore, according to an embodiment, the rudder angle $R_A$ of the PFD 100 is selected at least in part on the anticipated towing speed. A higher rudder angle $R_A$ is selected where a greater towing speed is anticipated, with the high towing speed offsetting some or all of the slower initial lateral movement of the tacking PFD 100, and the higher rudder angle $R_A$ offsetting some or all of the reduction in lateral movement caused by the increased speed.

In tests conducted by the inventor using a 24" life ring with a PFD tacking device attached and configured substantially as shown, the life ring was moved laterally to a position about 40° from a straight-line vector of travel, with the boat running at idle (about 6 knots).

Of course, there are many other factors that influence the behavior of a tacking PFD 100 in tow, including, for example, the size, weight, and shape of the PFD 102, the size of the tacking rudder 104, the angle of the tacking rudder relative to a horizontal plane, the length of the towline 118, etc.

Figure 5:
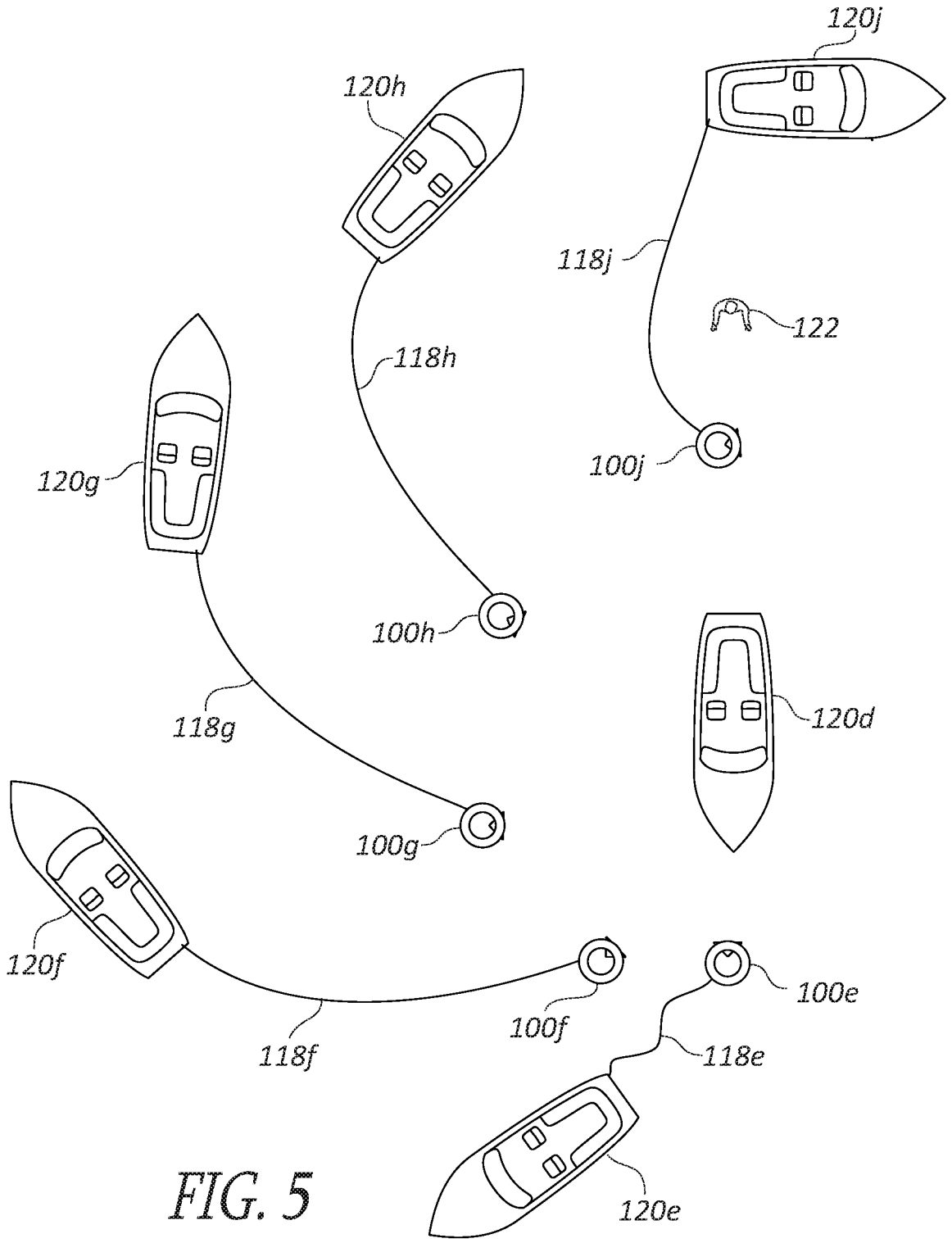
FIG. 5 is a diagram, in top plan view, of a procedure for bringing a tacking PFD 100 into reach of a man overboard, according to an embodiment.

FIG. 5 is a diagram, in top plan view, of a procedure for bringing a tacking PFD 100 under tow into reach of a MOB 122, according to an embodiment. The diagram of FIG. 5 represents a hypothetical rescue scenario with stages defined at d-j with the boat 120, the tacking PFD 100, and the towline 118 shown at each of the stages. After the MOB 122 enters the water, the boat 120 continues traveling forward a short distance, to d. The tacking PFD 100 is deployed at e with the boat at idle. The boat then goes hard over to starboard at f as the towline is pulled taut and continues until reaching a reciprocal heading at g. Assuming the boat has not traveled a significant distance from a, the entire procedure is performed at idle speed. Otherwise, the boat 120 may return at some higher speed until it nears the MOB 122, at which point it slows to avoid endangering the MOB and to permit the PFD 100 to move further out, As the boat 122 comes abreast of the MOB 122, it begins another hard turn to starboard, at h, until completing a 90° turn, at j. As the boat 120 continually turns to starboard, the tacking PFD 100 continues to move laterally, so that by the time it reaches the position shown at j, the tacking PFD may be at or beyond 90°, relative to the boat. As the boat continues forward, at dead slow, the tacking PFD 100 is pulled directly to the MOB 122.

The inventor has conducted tests with a large number of volunteer subjects, many of whom had never before piloted a boat. After receiving basic instructions on boat handling, and on the intended procedure, every subject was able to bring a tacking PFD—or its towline—into direct contact with a simulated MOB on the first attempt, within an average of around two minutes, and with none taking more than three minutes. In each case, following the test with a tacking PFD, each subject was asked to repeat the attempt with a standard PFD—without a PFD tacking device. The average time was over nine minutes, with most subjects requiring multiple passes, and with some of the subjects not able to successfully bring the towline or PFD within reach of the MOB.

Returning to FIGS. 2 and 3, it can be seen that, in the embodiment shown, a portion of the PFD tacking device 104 extends into the central opening of the life buoy PFD 102. During use, it is typically preferable for a MOB to position his body with the life ring around his chest. To prevent injury to a MOB, the straps 116 PFD tacking device 104 have a small amount of slack in them, which is sufficient to permit the tacking device to pivot partially into the opening of the ring, which clears the space for the MOB.

There are many different situations in which a tacking flotation device can be advantageous. For example, it is quite common for a patrol boat of the Coast Guard or a police agency, etc., to be called to assist a grounded vessel. In many of these cases, a towline is passed to the grounded vessel, which is then towed to deeper water. However, very often the patrol boat is unable to approach the grounded vessel without becoming grounded itself. In such cases, a small launch is typically deployed to carry the towline to the grounded vessel.

Figure 6:
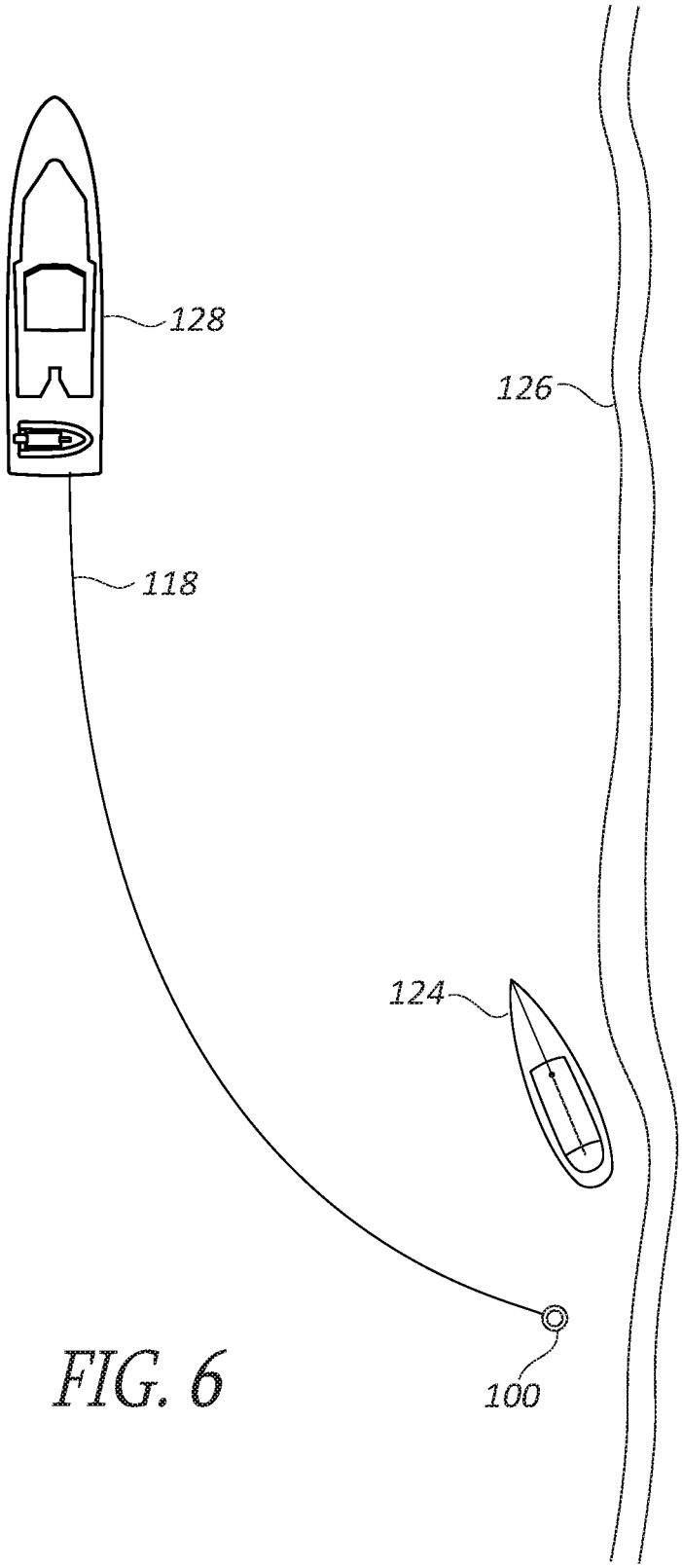
FIG. 6 is a diagram, in top plan view, of a procedure for bringing a tacking PFD 100 into reach of a grounded boat, according to another embodiment.

FIG. 6 is a diagram, in top plan view, showing a procedure for bringing a tacking PFD 100 under tow into reach of a vessel 124 grounded near a shoreline 126, according to an embodiment. Approaching the vessel 124 from some distance, the patrol boat 128 cruises slowly, parallel to the shoreline 126 and far enough out to ensure its own safety, towing the PFD 100 at the end of a towline 118. The tacking device (not shown in detail in FIG. 6) carries the PFD 100 closer to the shoreline 126. The helmsman of the patrol boat adjusts boat speed and distance from the shoreline to bring the PFD directly to the grounded vessel, where a crew member can use a boat hook or similar tool to bring the PFD 100 and the end of the towline 118 aboard. A towing cable can then be attached to the towline 118 and pulled aboard the grounded vessel 124. The towing cable is then made fast to the vessel 124, and the patrol boat 128 pulls the vessel to deeper water. The towline 118 and PFD 100 are then reattached to the towing cable and pulled back aboard the patrol boat 128. The procedure described with reference to FIG. 6 is simpler and faster than delivering a towing cable via motor launch. Additionally, it is a much safer procedure, particularly in high seas or under adverse weather conditions.

Another common situation is where individuals become stranded on a riverbank or on an island or other feature in a river. This can occur when a boat is capsized or damaged by rough water, or when flood waters rise suddenly, etc. In such situations, it may be possible to reach a stranded party by boat, but sometimes it is necessary to call a helicopter to hover and drop a ladder to the stranded party. Whether by boat, by helicopter, or by other means, such rescues can be extremely dangerous.

Figure 7:
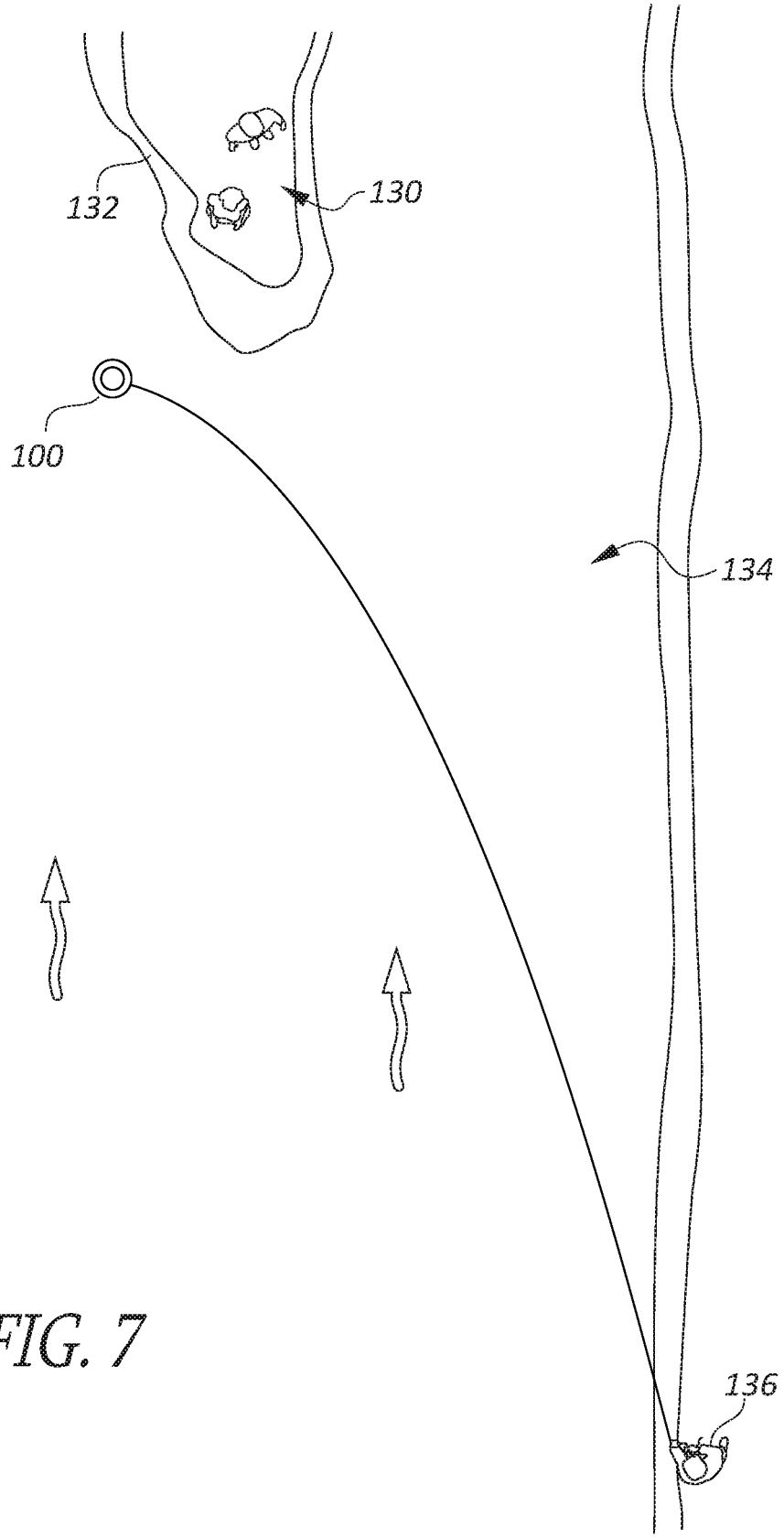
FIG. 7 is a diagram, in top plan view, of a procedure for bringing a tacking PFD 100 into reach of stranded group across a river, according to an embodiment.

FIG. 7 is a diagram, in top plan view, showing a procedure for bringing a tacking PFD 100 to a party of people 130 stranded on a small islet 132 in a river 134, according to an embodiment. A rescue worker 136 stands upstream from the stranded party 130 on the nearest accessible bank 140 of the river 134, and pays out a towline 118, which floats with the current $C_W$ toward the stranded party 130. As the PFD 100 nears the islet 132, the rescue worker applies resistance to further movement of the towline 118, causing water to flow past the tacking PFD 100. The movement of current causes the PFD 100 to tack laterally across the river 132. In the example shown, the rescue worker 136 is able to control the PFD 100 so that it passes down the river channel on the side of the islet 132 opposite the worker. In this way, the rescue worker 136 is able to deliver the towline 118 to the stranded party without their being required to retrieve the line from the water. In other circumstances, it may be necessary for the stranded party to use other means to retrieve the line, such as an improved hook, etc. Once the towline 118 has reached the stranded party, the remaining steps of the rescue operation will depend upon the circumstances, the training of the rescue personnel, the physical abilities of the members of the stranded party, etc. For example, the towline may be made fast across the river, and each member of the stranded party attached to the line by a harness with a sliding loop, permitting them to cross the waters safely.

Again, it will be recognized that the method described above is, in many cases faster and safer than the previously available alternatives.

Figure 8:
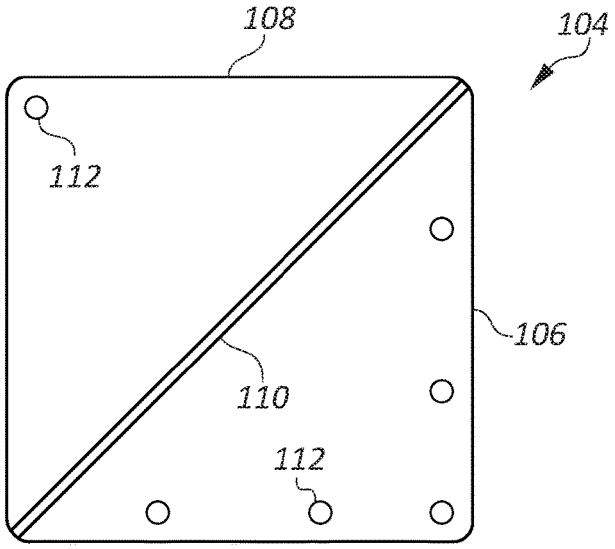
Figure 10:
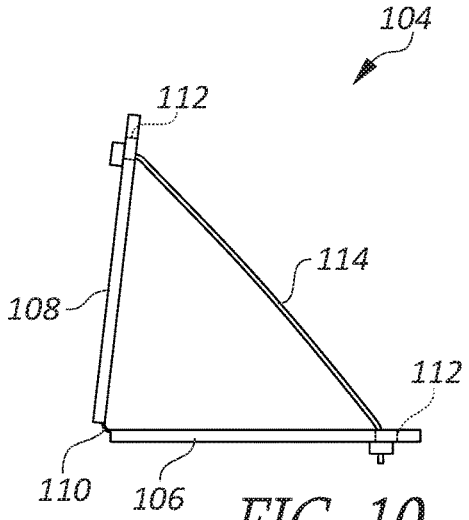
Figure 9:
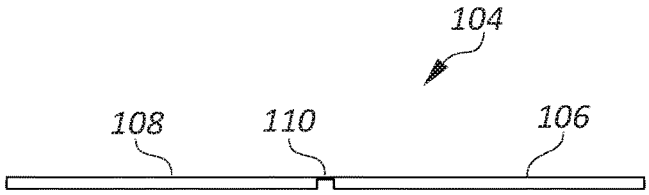
Figure 11:
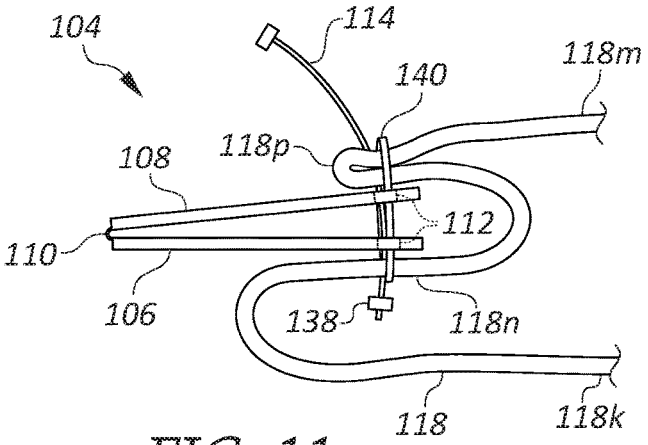

FIGS. 8-11 are views of the PFD tacking device 104 described above with reference to FIGS. 2 and 3, in various configurations, according to an embodiment. FIG. 8 is a bottom plan view; FIG. 9 is a side elevation view along an axis defined by the hinge 110. FIG. 10 is a side elevation view of the device in a deployed configuration, and FIG. 11 is a side elevation view of the device in a stowed configuration.

According to an embodiment, the PFD tacking device 104 is made from a single piece of an appropriate material, such as polyethylene, polypropylene, high-density polyethylene (HDPE), etc. The hinge 110 is in the form of a groove with a selected width and depth, made by one or more parallel saw cuts that have removed material along the hinge line, leaving a thin portion of the material to act as a "living hinge." The limiting strap 114 is made from a cable tie with the ratchet end 138 of a second tie positioned to provide a strap of a selected length. It will be noted that, in the embodiment shown, the angle of the tacking rudder 108 relative to the base plate 106 is slightly less than 90°. The inventor has found that a slightly acute angle helps reduce or prevent a tacking PFD from skipping out of the water while under tow.

While in the stowed configuration, as shown in FIG. 11, the hinge 110 is folded so that the tacking rudder 108 is not quite contacting the base plate 106. This provides space for the straps 116, and also ensures that water pressure will force the tacking rudder 108 into the deployed configuration, even in the absence of an opening bias. In the embodiment shown, a self-releasing loop arrangement is used to hold the device in the stowed configuration. Typically, a PFD is positioned on a vessel with the towline attached, in a location from which it can be instantly deployed. In the view of FIG. 11, a first end 118*k* of the towline 118 is attached to the PFD 102, while the second end 118*m* is coupled to the towing vessel. the towline passes through a small loop 140 at 118*n*, which can, for example, be a second cable tie. The small loop itself passes through the same apertures 112 as the limiting strap 114. A bight 118*p* of the towline is then passed through the small loop 124 on the opposite side of the PFD tacking device 104. This arrangement keeps the tacking rudder 108 in its stowed configuration, which permits the PFD 100 to be hung on the side of a deckhouse or bulkhead with minimal obstruction.

To deploy the tacking PFD, a user simply pulls on the second end 118*b* of the towline 118, pulling the bight 118*d* from the small loop 124, which is then pulled from the apertures 112 by the towline at 118*c*. According to another method of deployment, the user simply throws the tacking PFD into the water. The pull on the towline 118 as the boat begins to move is sufficient to pull the bight 118*c* from the loop 124 and the loop from the apertures 112, automatically deploying the tacking rudder 108.

According to an embodiment, a PFD tacking device 104 is provided for use in retrofitting a PFD. Accordingly, according to an embodiment, instructions are provided to assist a user in attaching the device to a PFD, and for effectively using a PFD equipped with a tacking device. According to one embodiment, the instructions are printed directly on the device. According to another embodiment, instructions are provided with the packaging of the device. According to a further embodiment, the advertising is provided, to bring the device and methods to the attention of boat owners, handlers, enthusiasts, etc.

Figure 12:
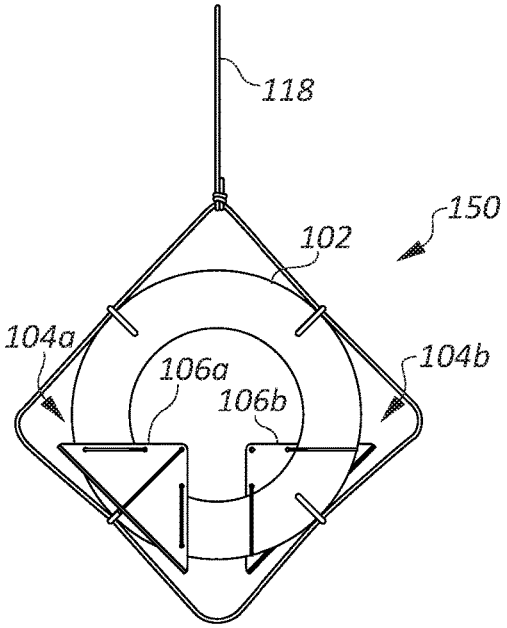
FIGS. 12-18 are 8 views of tacking PFDs, according to respective additional embodiments.

FIGS. 12-18 are views of tacking PFDs, according to respective embodiments. FIG. 12 shows a tacking PFD 150 that is similar to the tacking PFD 100 described above, with a PFD tacking device 104*a* positioned as previously described. However, in addition, a second PFD tacking device 104*b* is attached to the PFD 102 on the side facing away from the viewer in the drawing. This arrangement allows the tacking PFD 150 to operate with either side of the PFD 102 facing down in the water. The PFD 150 will move in the same direction, laterally, whichever side is facing downward.

Figure 13:
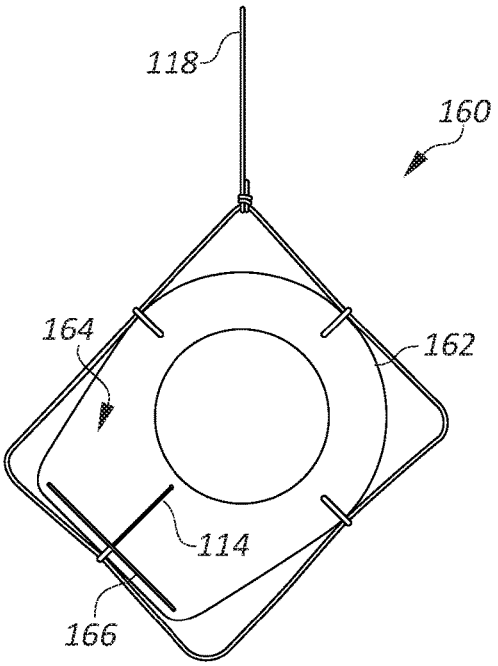

FIG. 13 shows a tacking PFD 160 that includes a PFD tacking device 162 that is integrated with a PFD 164. The shape of the PFD 164 is modified to accommodate a tacking rudder 166 without an additional base plate, and provides sufficient space for the rudder to fold without impinging on the central opening of the PFD. This reduces the likelihood of injury to a MOB during a rescue operation. Similar to the embodiment described with reference to FIG. 3, the direction of lateral movement can be selected by selection of the coupling point of the towline 118. According to an alternative embodiment, a second tacking rudder is positioned on the opposite side of the PFD 164, directly opposite the visible tacking rudder 166. This permits the direction of movement of the device to be selected by selection of the side of the device that is placed downward in the water.

Figure 14:
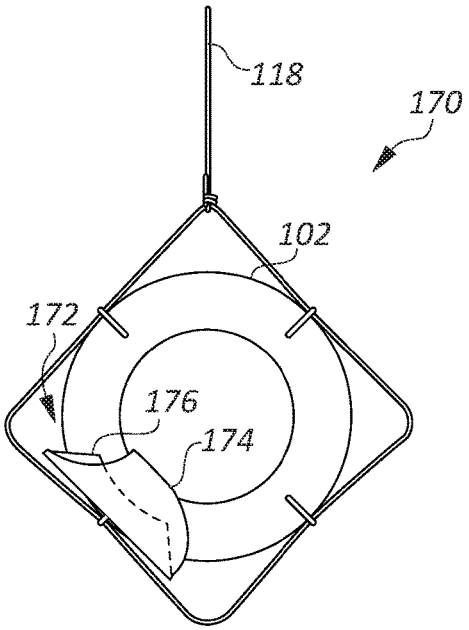

FIG. 14 shows a tacking PFD 170 that includes a PFD tacking device 172 that includes a tacking rudder 174 made from a stout fabric, such as canvas, sailcloth, ripstop nylon, etc. The rudder 174 is approximately triangular, with one side of the triangle attached to a support plate 176 that is attached to the PFD 102, and the opposite point coupled to the PFD 102 with a selected amount of slack. While under tow, the tacking rudder fills in a manner similar to a sail, and acts as a channel to divert a flow of water and create the laterally applied force. Similar to the embodiment described with reference to FIG. 3, the direction of lateral movement can be selected by selection of the coupling point of the towline 118.

Figure 15:
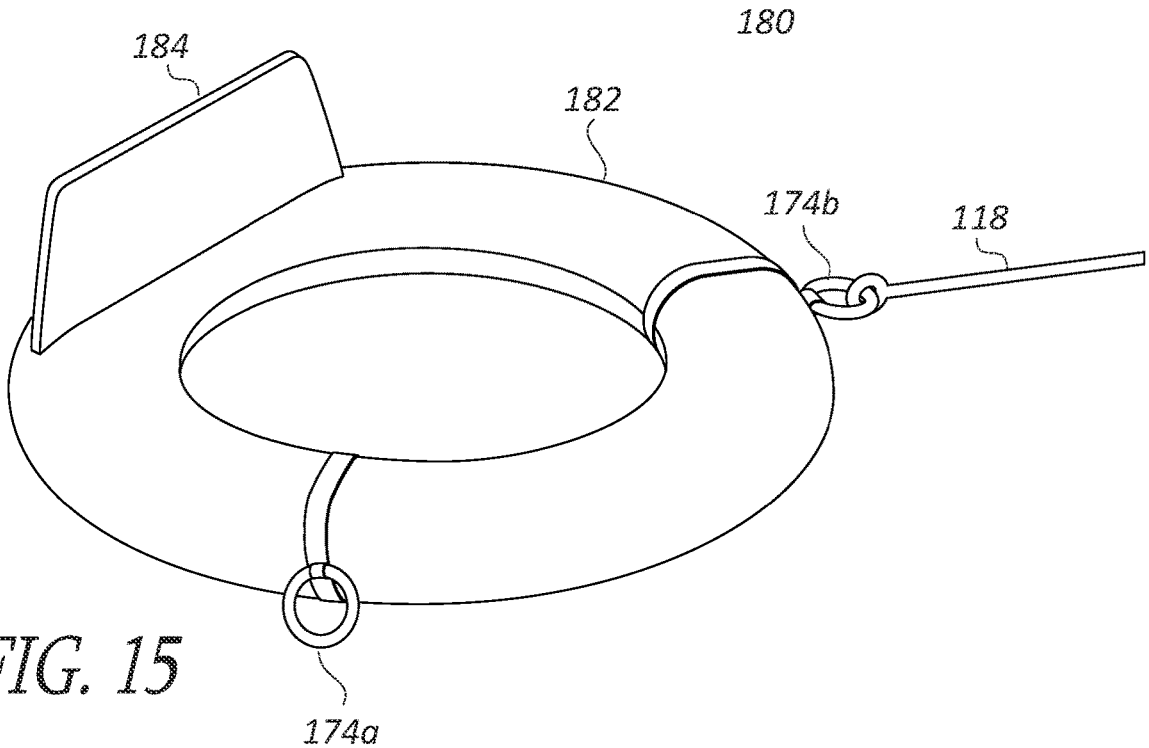

FIG. 15 shows a tacking PFD 180 that includes a PFD 182 with a tacking rudder 184 formed integrally therewith. Coupling points 174*a*, 174*b* are provided and configured to receive a towline 118 attached. The direction of tacking can be selected by selection of the coupling point. Operation of the tacking PFD 180 is substantially as described with reference to previous embodiments. According to an embodiment, the material of the tacking rudder is selected to have some resiliency, to permit it to fold while in storage, and to avoid injury to a MOB, etc.

Figure 16:
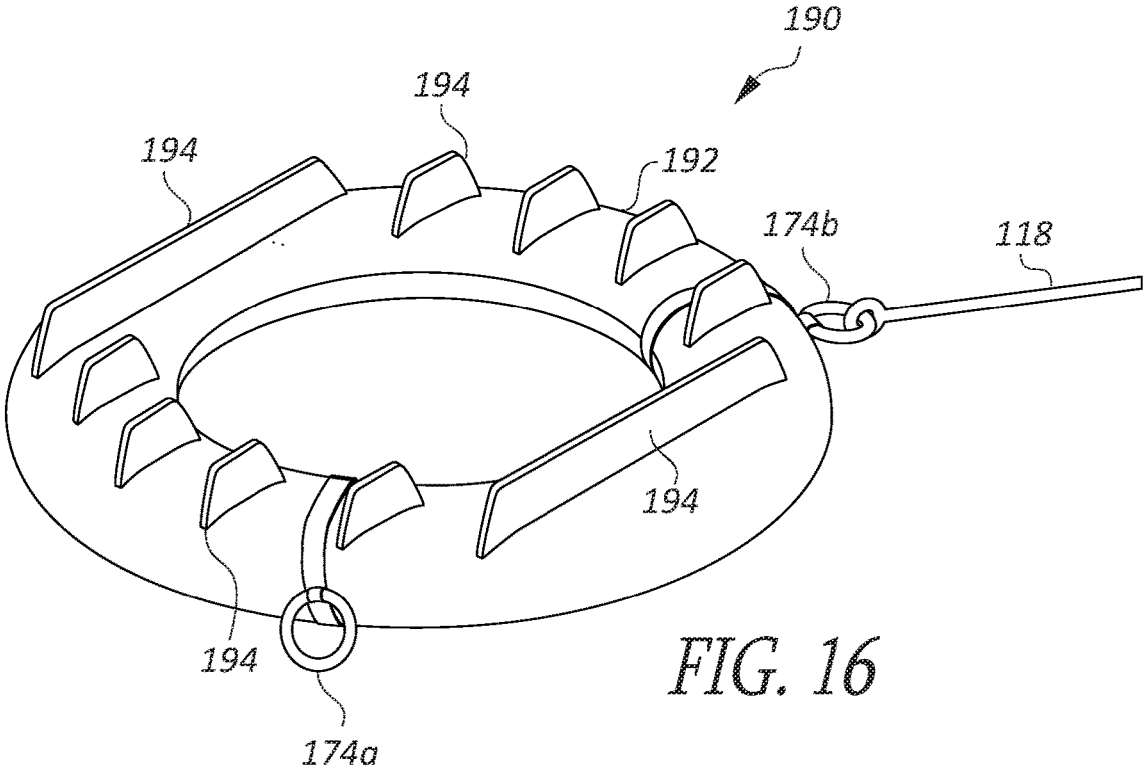

FIG. 16 shows a tacking PFD 190 that includes a PFD 192 with a plurality of tacking rudders 194 formed integrally therewith, according to an embodiment. Coupling points 174*a*, 174*b* are provided and configured to receive a towline 118, as described with reference to FIG. 15. The direction of tacking can be selected by selection of the coupling point. The plurality of tacking rudders 194 can be much shorter than those of previous embodiments while still presenting more rudder surface to water flowing past. Additionally, because there are tacking rudders 194 across the entire lower surface, there is less likelihood that the device will lose lateral force if a portion skips out of the water. Furthermore, because the rudders can be shorter without losing effectiveness, the joint where each rudder 194 joins with the body of the PFD 192 can be subjected to less force as water flows past, and so each rudder can be more resilient without yielding to the flow.

Figure 17:
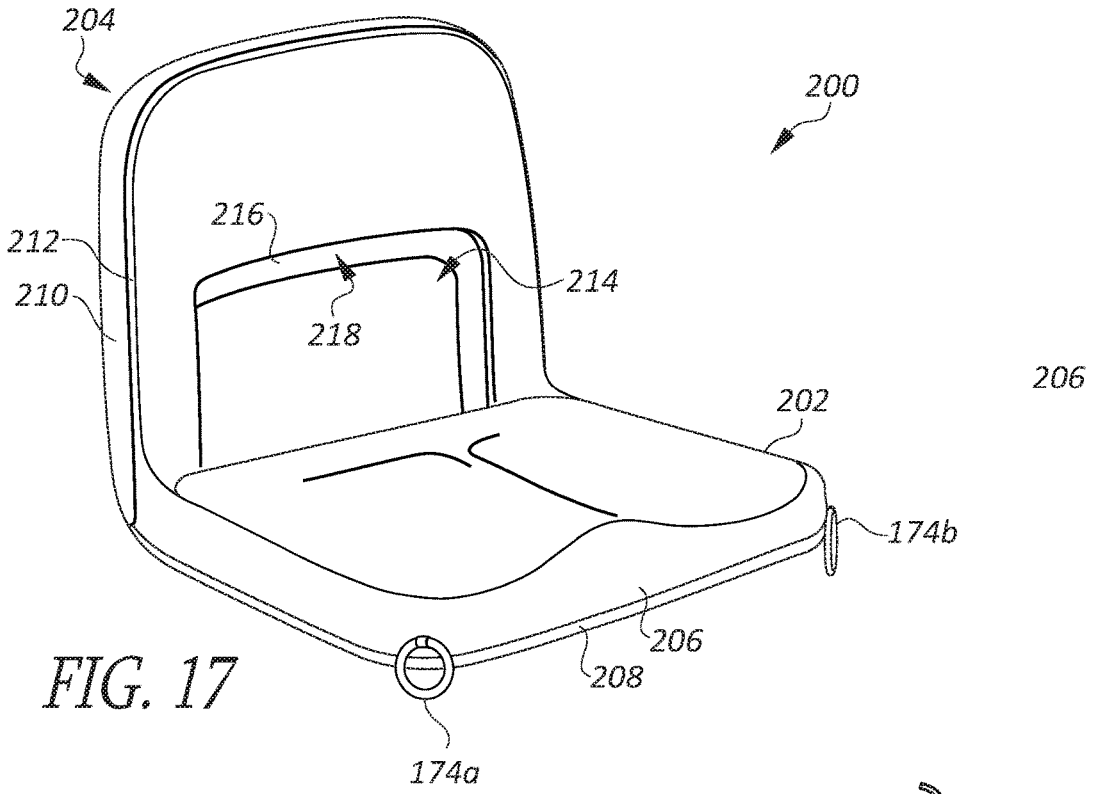

FIG. 17 shows a tacking PFD 200 that includes a PFD 202 and a tacking rudder 204, according to an embodiment. In the embodiment of FIG. 17, the PFD 202 is in the form of a seat cushion, while the tacking rudder 204 is in the form of a seat back. The PFD 202 includes a buoyant layer 206, and in embodiments where the buoyant layer is not sufficiently strong, a stronger and more rigid reinforcing layer 208 is provided. Coupling points 174*a*, 174*b* are also provided. The tacking rudder 204 includes a relatively rigid layer 210 that is denser than water so that it will not tend to float. The tacking rudder can also include a more resilient layer 212 for a user's comfort. The tacking rudder 204 also includes an aperture 214 so that a user can lock hands through the aperture to hold more securely to the device. Additionally, the embodiment shown includes a transition edge 216 extending between the front and back of the tacking rudder 204 within the aperture 214. The transition edge 216 has a deflection face 218 that is angled downward from front to back, as viewed in FIG. 17.

When the tacking PFD 200 is positioned in the water with the tacking rudder extending downward, and towed through the water from one or the other of the coupling points 174*a*, 174*b*, water contacting the deflection face 218 as it passes through the aperture 214 produces a downward force on the tacking rudder 204, acting to offset any tendency of the tacking rudder to rise out of the water while under tow. The tacking PFD 200 of FIG. 17 is configured for use as a seat that can, in an emergency, be used as a flotation device or as a tacking PFD.

According to a further embodiment, a hinge is provided between the PFD 202 and the tacking rudder 204, permitting the tacking rudder to be folded down over the PFD into a more compact configuration.

Typically, when a towed rider, such as a water skier, falls or otherwise releases the tow handle, the boat operator turns the boat and circles the rider to bring the tow handle back into reach of the rider. However, as with PFD's, as described above, it can be difficult for a boat handler to bring a floating tow handle into reach of a person in the water, so that the rider is frequently obligated to swim toward the rope to regain possession of the handle. Although cold water is not generally a problem, a rider may have a wake board, or one or two water skis attached, making it difficult to swim toward the rope.

Figure 18:
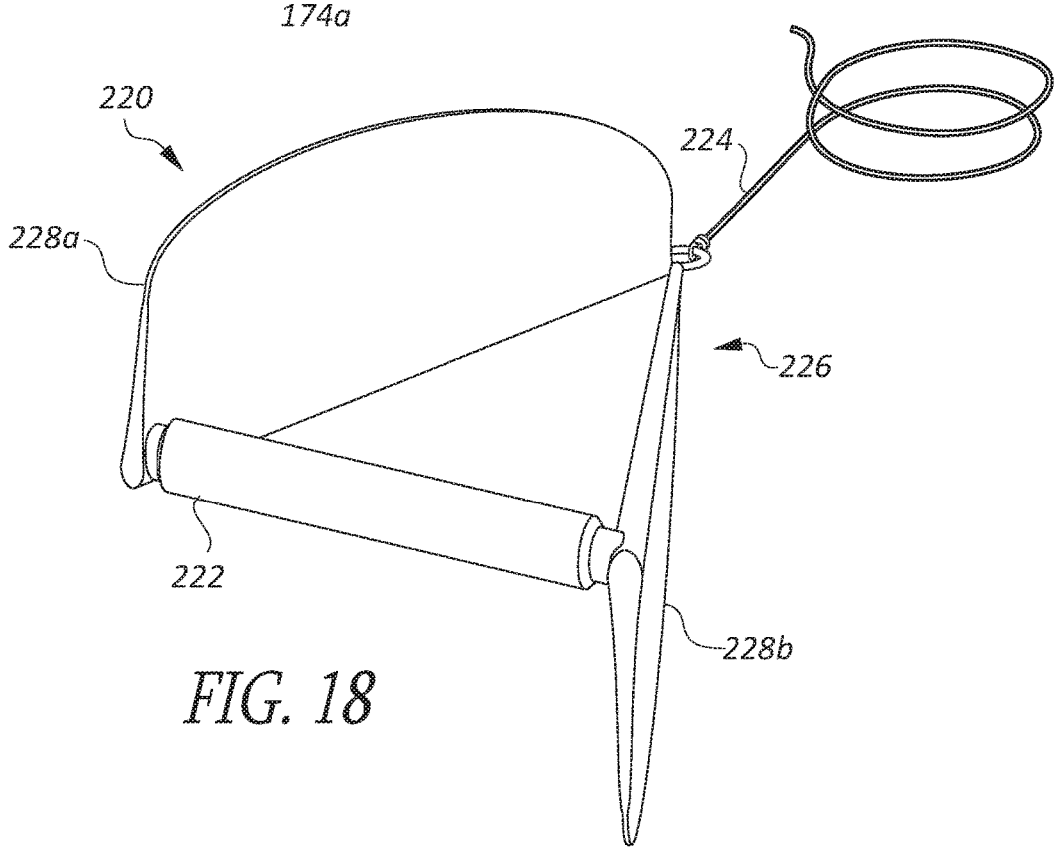

FIG. 18 shows a tacking tow handle 220, such as can be used in water activities in which an individual is towed behind a boat on water skis, a wakeboard, or the like. The individual holds a cross bar 222 of the handle 220, which is coupled to a tow rope 224 via a yoke 226. In the embodiment shown, the tow handle 200 includes first and second tacking rudders 228*a*, 228*b*, one extending upward from one side of the yoke 226, and the other extending downward from the opposite side of the yoke. The tacking rudders 228 have sufficient resiliency as to prevent injury to a user, but are, at least along the edges, denser and heavier than water, while overall, the tow handle 220 is configured to float. In operation, when a rider releases the handle 220, the boat operator turns the boat and circles the rider. The tacking tow handle 220 moves to one side, enabling the boat operator to bring the town handle to the rider using, for example, the method described with reference to FIG. 5.

In general, the term PFD, i.e., personal flotation device, has been used with reference to many of the embodiments disclosed above. However, it will be recognized that many embodiments can be carried out without the use of a personal flotation device, at least as the term might be most strictly interpreted. For example, in the methods described with reference to FIGS. 6 and 7, it will be recognized that a device used to deliver a line or cable does not necessarily need to be configured to support a person in the water, but only needs to float. Similarly, the water ski tow handle described with reference to FIG. 18 might not have sufficient buoyancy to support a person in the water. Nevertheless, for the purposes of the present disclosure and claims, the term personal flotation device is to be interpreted with sufficient breadth as to encompass such devices.

The abstract of the present disclosure is provided as a brief outline of some of the principles of the invention according to one embodiment, but is not intended as a complete or definitive description of any single embodiment thereof, nor should it be relied upon to define terms used in the specification or claims. The abstract does not limit the scope of the claims.

Reference throughout this specification to "one embodiment" or "an embodiment," and variations thereof, indicates that a particular feature, structure, or characteristic described in connection with the embodiment is included in at least one embodiment. Thus, phrases such as "in one embodiment" or "according to another embodiment," as used in various places throughout this specification do not necessarily all refer to the same embodiment, nor do they suggest that the features described are limited to any single embodiment. Rather, specific embodiments of the invention have been described herein for purposes of illustration, but individual features, structures, or characteristics described with reference to various separate embodiments can be modified or combined in any suitable manner to form additional embodiments without deviating from the spirit and scope of the invention. The scope of the claims is therefore not limited by particular embodiments set forth herein but should be construed in a manner consistent with the specification as a whole.

What is claimed is:

1. A device configured to be towed in water, comprising:

a personal flotation device;

a towline attachment point on the personal flotation device, configured to receive a towline;

a tacking rudder coupled to the personal flotation device at an angle that is less than 90 degrees relative to a direction of travel when the personal flotation device is towed through water by a line coupled to the towline attachment point, such that, when the personal flotation device is towed through the water with the tacking rudder extending downward, water flowing past the tacking rudder imparts, to the personal flotation device, a lateral force relative to the direction of travel; and wherein:

the personal flotation device is in the form of a water ski tow rope handle, and includes a cross bar coupled to a tow rope via a yoke; and the tacking rudder is one of two tacking rudders, a first coupled to one side of the yoke and extending in a first direction, the other of the two tacking rudders coupled to the other side of the yoke and extending in a second direction, opposite the first direction.

* * * * *